US006827412B2

(12) United States Patent
Inui et al.

(10) Patent No.: US 6,827,412 B2
(45) Date of Patent: Dec. 7, 2004

(54) INK JET PRINTING APPARATUS, IMAGE PROCESSING METHOD AND INK JET PRINTING METHOD

(75) Inventors: Toshiharu Inui, Kanagawa (JP); Masaya Uetsuki, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/357,359

(22) Filed: Feb. 4, 2003

(65) Prior Publication Data

US 2003/0146945 A1 Aug. 7, 2003

(30) Foreign Application Priority Data

Feb. 5, 2002 (JP) ..... 2002-028782
Jan. 30, 2003 (JP) ..... 2003-022794

(51) Int. Cl.[7] ..... B41J 2/195; B41J 29/38
(52) U.S. Cl. ..... 347/7; 347/14
(58) Field of Search ..... 347/7, 14

(56) References Cited

U.S. PATENT DOCUMENTS 6,019,449 A * 2/2000 Bullock et al. ..... 347/14
6,151,039 A * 11/2000 Himelar et al. ..... 347/7
6,454,381 B1 * 9/2002 Olsen et al. ..... 347/19
2001/0038396 A1 11/2001 Imanaka et al. ..... 347/7
2002/0118236 A1 8/2002 Uetsuki ..... 347/7
2003/0071862 A1 * 4/2003 Tsukada et al. ..... 347/7

FOREIGN PATENT DOCUMENTS

EP 1 079 326 2/2001 ..... G06K/15/02
JP 2001-63058 3/2001 ..... B41J/2/05

* cited by examiner

*Primary Examiner*—Stephen Meier
*Assistant Examiner*—Alfred Dudding
(74) *Attorney, Agent, or Firm*—Fitzpatrick, Cella, Harper & Scinto

(57) ABSTRACT

To enable an ink jet printing apparatus to produce high quality images at all times from the initial stage of use until the end of its service life, the present invention provides an ink jet printing method for printing an image on a print medium by using a print head, in which the print head can eject ink supplied from an ink tank. The ink jet printing method includes an ink consumption detection step for detecting an amount of ink consumed in the ink tank, an ejection number detection step for detecting the number of ink ejections from the print head, an ink droplet volume calculation step for calculating an ink droplet volume based on the number of ink ejections from the print head and the ink consumption, and a control step for changing processing associated with a printing operation according to the ink droplet volume calculated by the calculation step.

12 Claims, 13 Drawing Sheets

| | | | |
|---|---|---|---|
| Y EJECTION VOLUME -2 LUT | M EJECTION VOLUME -2 LUT | C EJECTION VOLUME -2 LUT | K EJECTION VOLUME -2 LUT |
| Y EJECTION VOLUME -1 LUT | M EJECTION VOLUME -1 LUT | C EJECTION VOLUME -1 LUT | K EJECTION VOLUME -1 LUT |
| Y EJECTION VOLUME 0 LUT | M EJECTION VOLUME 0 LUT | C EJECTION VOLUME 0 LUT | K EJECTION VOLUME 0 LUT |
| Y EJECTION VOLUME +1 LUT | M EJECTION VOLUME +1 LUT | C EJECTION VOLUME +1 LUT | K EJECTION VOLUME +1 LUT |
| Y EJECTION VOLUME +2 LUT | M EJECTION VOLUME +2 LUT | C EJECTION VOLUME +2 LUT | K EJECTION VOLUME +2 LUT |

FIG.12A

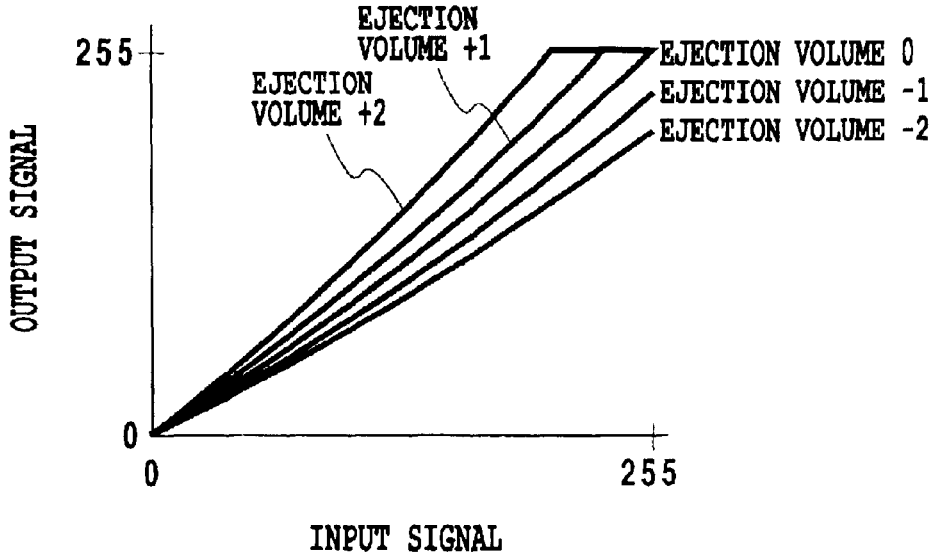

FIG.12B

INK JET PRINTING APPARATUS, IMAGE PROCESSING METHOD AND INK JET PRINTING METHOD

This application claims priority from Japanese Patent Application Nos. 2002-028782 filed Feb. 5, 2002 and 2003-022794 filed Jan. 30, 2003, which are incorporated hereinto by reference.

BACKGROUND OF THE INVENTION

1. Field of the Invention

The present invention relates to an ink jet printing apparatus, an image processing method and an ink jet printing method which form an image on a print medium by ejecting ink from a print head.

2. Description of the Related Art

Ink jet printing apparatus capable of producing color images usually have a plurality of print heads each ejecting one of four different color inks, cyan, magenta, yellow and black (simply referred to as C, M, Y and K). In recent years, to minimize a granular impression that dots in highlight areas give, there is a growing trend toward producing color images by using light inks with lower densities and dark inks with commonly used densities.

In ink jet printing apparatus currently in wide use, the four color inks (C, M, Y and K) or six color inks, which include LC (lighter cyan ink than C) and LM (lighter magenta ink than M) in addition to Y, M, C and K, are used in separate dedicated print heads. It is known that there is an ejection variation among individual print heads due to a structural variation among the print heads caused by the manufacturing process. The current level of this variation is about ±10% of a standard ejection volume. The ejection volume variation among print heads means an ejection volume variation among different color inks, which in turn results in variations in density and color of printed images.

Printers are designed to determine a tone of an output image based on a standard ejection volume of each print head. Hence, if the print heads used have ejection volumes that are deviated from the standard volumes, an image formed by these print heads will have a different tone from that of a target image. Because of a rapid advance in color printing technology of the ink jet printing apparatus in recent years, these apparatus produce photograph-like images that are now close in quality to silver salt pictures. In such photograph-like images, the tone is an important factor that determines the image quality. If a target tone fails to be obtained, there is a risk of undesired phenomena showing up, such as a degradation of color reproducibility, a partial loss of gradation (particularly a degradation of gray scale reproducibility caused by a loss of balance between a dark ink and a light ink of the same color, and a loss of a linear gray scale characteristic), and a formation of pseudo-outline, which may result in a significant impairment of image quality.

To solve the problems described above, a commonly used method involves printing a test pattern to check an ejection volume variation, reading the printed test pattern by a scanner, determining a level of the ejection volume based on a scanned signal level, and changing parameters of image processing according to the ejection volume level. With this method, although a degradation of image quality can be avoided, the user needs to print a test pattern and a reading device such as scanner is required, making the system complex and expensive.

Another method is also known in which a test pattern for determining the level of ejection volume is printed to be visually checked by the user who then enters the check result into a host computer through a user interface to correct the tone. This method however has a problem that because it relies on the user's visual check, the decision may vary depending on the individual user's ability or a wrong decision may be made. There is also a possibility of input errors. These in turn will degrade image quality.

Still another method, disclosed in Japanese Patent Application Laid-open No. 2001-063058, has been proposed. In this method the host computer obtains information on the print head ejection volumes preset in a memory installed in the printing apparatus and, according to the ejection volume information, changes image processing parameters in a printer driver in the host computer. Since in this method the information on the print head ink ejection volumes is written into the memory before the printing apparatus is shipped, a high quality output image can be obtained at an initial stage of use through the modification of image processing parameters according to the written ejection volumes.

As the operating hours of the printer accumulate, the actual ejection volumes of the print heads may progressively change with elapse of time, a so-called secular change. This is considered due to changes in the size of bubbles in ink that may be caused by burned electrothermal transducers (heaters) in the print heads or by a slight change in the heater film thickness. In such a case, simply modifying the image processing parameters according to the initial ink ejection volumes stored in the memory can hardly keep a high quality output image for a long period of use.

SUMMARY OF THE INVENTION

The present invention has been accomplished with a view to overcoming the above-described problems of the conventional art. It is therefore an object of the present invention to provide an ink jet printing apparatus, an ink jet printing method and an image processing method that enable high quality images to be produced from the initial stage of use of the printing apparatus until the end of its service life.

To achieve the above objective, this invention has the following construction. That is, the present invention provides an ink jet printing apparatus for printing an image on a print medium by using a print head, wherein the print head can eject ink supplied from an ink tank, the ink jet printing apparatus comprising: ink consumption detection means for detecting an amount of ink consumed in the ink tank; ejection number detection means for detecting the number of ink ejections from the print head; ink droplet volume calculation means for calculating an ink droplet volume based on the number of ink ejections from the print head detected by the ejection number detection means and the ink consumption detected by the ink consumption detection means; and control means for changing processing associated with a printing operation according to the ink droplet volume calculated by the ink droplet volume calculation means.

Further, the present invention provides an image processing method for processing print data used to print an image on a print medium by using a print head, wherein the print head can eject ink supplied from an ink tank, the image processing method comprising: an ink consumption detection step for detecting an amount of ink consumed in the ink tank; an ejection number detection step for detecting the number of ink ejections from the print head; an ink droplet volume calculation step for calculating an ink droplet volume based on the number of ink ejections from the print head detected by the ejection number detection step and the ink consumption detected by the ink consumption detection step; and a change step for changing image processing performed on the print data according to the ink droplet volume calculated by the ink droplet volume calculation step.

Further, the present invention provides an ink jet printing method for printing an image on a print medium by using a print head, wherein the print head can eject ink supplied from an ink tank, the ink jet printing method comprising: an ink consumption detection step for detecting an amount of ink consumed in the ink tank; an ejection number detection step for detecting the number of ink ejections from the print head; an ink droplet volume calculation step for calculating an ink droplet volume based on the number of ink ejections from the print head detected by the ejection number detection step and the ink consumption detected by the ink consumption detection step; and a control step for changing processing associated with a printing operation according to the ink droplet volume calculated by the ink droplet volume calculation step.

Further, the present invention provides an ink jet printing apparatus for printing an image on a print medium by using a print head, wherein the print head can eject ink supplied from an ink tank, the ink jet printing apparatus comprising: an ink consumption information obtaining means for obtaining information corresponding to an amount of ink consumed in the ink tank; ejection number information obtaining means for obtaining information corresponding to the number of ink ejections from the print head; ink droplet volume information obtaining means for obtaining information corresponding to an ink droplet volume based on the ink ejection number information obtained by the ejection number obtaining means and the ink consumption information obtained by the ink consumption information obtaining means; and control means for changing processing associated with a printing operation according to the ink droplet volume information obtained by the ink droplet volume information obtaining means.

Further, the present invention provides an image processing method for processing print data used to print an image on a print medium by using a print head, wherein the print head can eject ink supplied from an ink tank, the image processing method comprising: an ink consumption information obtaining step for obtaining information corresponding to an amount of ink consumed in the ink tank; an ejection number information obtaining step for obtaining information corresponding to the number of ink ejections from the print head; an ink droplet volume information obtaining step for obtaining information corresponding to an ink droplet volume based on the ink ejection number information obtained by the ejection number obtaining step and the ink consumption information obtained by the ink consumption information obtaining step; and a change step for changing image processing performed on the print data according to the ink droplet volume information obtained by the ink droplet volume information obtaining step.

With this construction, since the ink ejection volume that changes over time is calculated and, based on the calculated result, the data related to the image forming processing is corrected, it is possible to produce high quality images at all times from the initial stage of use of the printing apparatus till the end of its service life.

The above and other objects, effects, features and advantages of the present invention will become more apparent from the following description of embodiments thereof taken in conjunction with the accompanying drawings.

BRIEF DESCRIPTION OF THE DRAWINGS

FIGS. 12A and 12B are explanatory diagrams showing an example output gamma table in the embodiment of this invention.

DETAILED DESCRIPTION OF PREFERRED EMBODIMENTS

Now, embodiments of the present invention will be described by referring to the accompanying drawings.

Figures 1A, 1B:
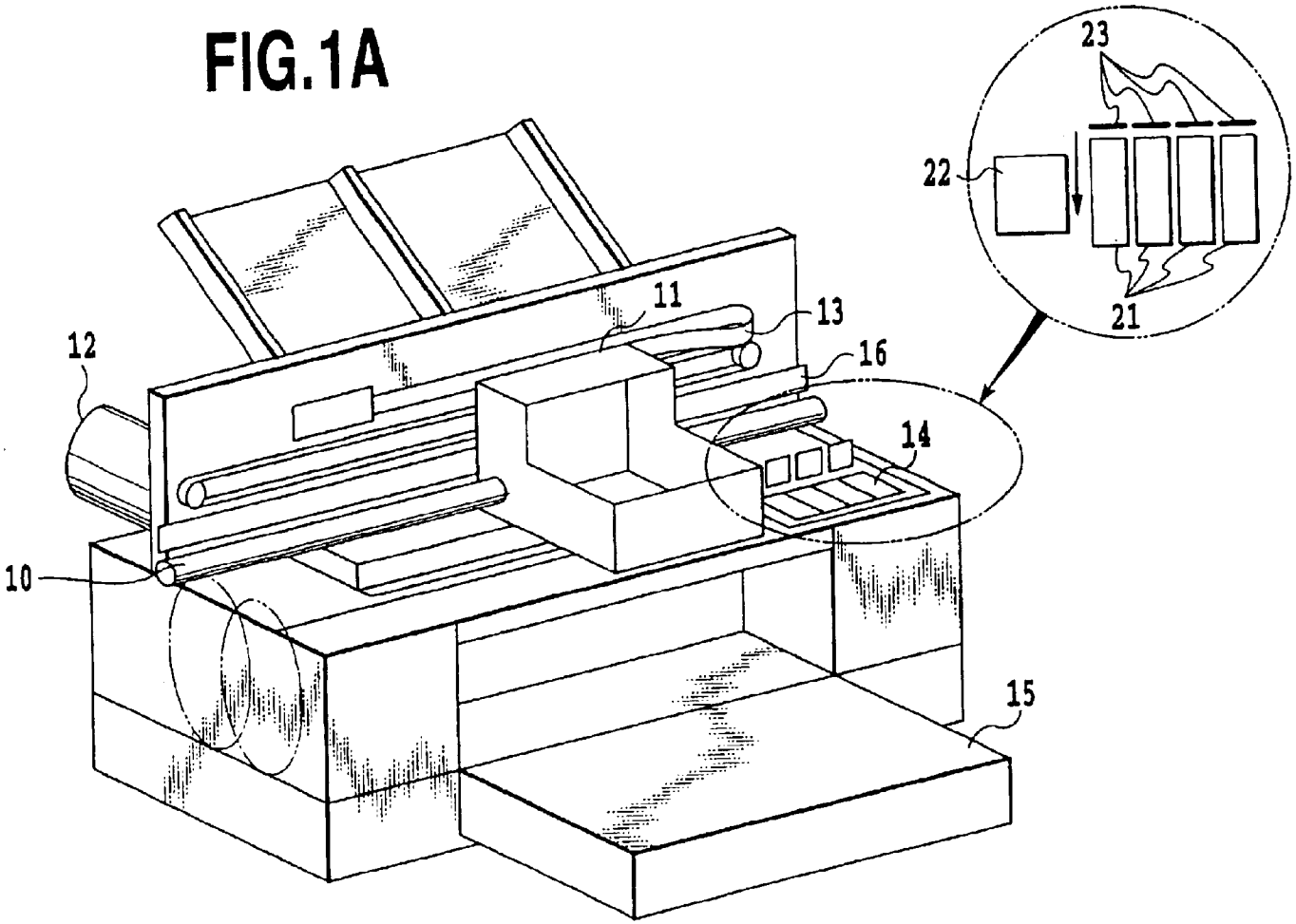
FIG. 1A is a perspective view showing an outline construction of an ink jet printing apparatus in one embodiment of the present invention.
FIG. 1B is an enlarged plan view showing a recovery means of FIG. 1A.

FIG. 1A is an overall perspective view showing an outline construction of a printing apparatus in one embodiment of the present invention. This printer is a so-called serial scan type ink jet printing apparatus which causes the ink jet print heads to eject inks onto a print medium such as paper as they are scanned over the print medium in a main scan direction X1, X2 perpendicular to a subscan direction Y in which the print medium is fed.

That is, this ink jet printing apparatus has a carriage 11 on which the ink jet print heads (or simply referred to as print heads) are mounted, a carriage motor 12 for driving the carriage 11 in the main scan direction, a flexible cable 13 for sending electric signals from a control unit (not shown) in the printing apparatus to the print heads, a recovery means 14 for performing a recovery operation on the print heads 9, a paper feed tray 15 for holding stacked sheets of paper as print mediums, and an optical position sensor 16, such as an optical encoder, for optically reading the position of the carriage 11.

In the ink jet printing apparatus of the above construction, the carriage 11 is reciprocally moved along the guide shaft 10 in the main scan direction to print on a print area of the width corresponding to the number of nozzles of each print head 9 and the paper is fed a predetermined distance intermittently during the nonprinting operation.

FIG. 1B is a plan view showing the recovery means 14 enlarged. In the figure, reference number 21 represents suction and rest caps; 22 represents an ink receiver that receives ink ejected during an ejection recovery operation; and 23 represents wiper blades that wipe print head faces formed with nozzle openings (nozzle-formed surfaces) as they move in the direction of the shown arrow.

Figure 2:
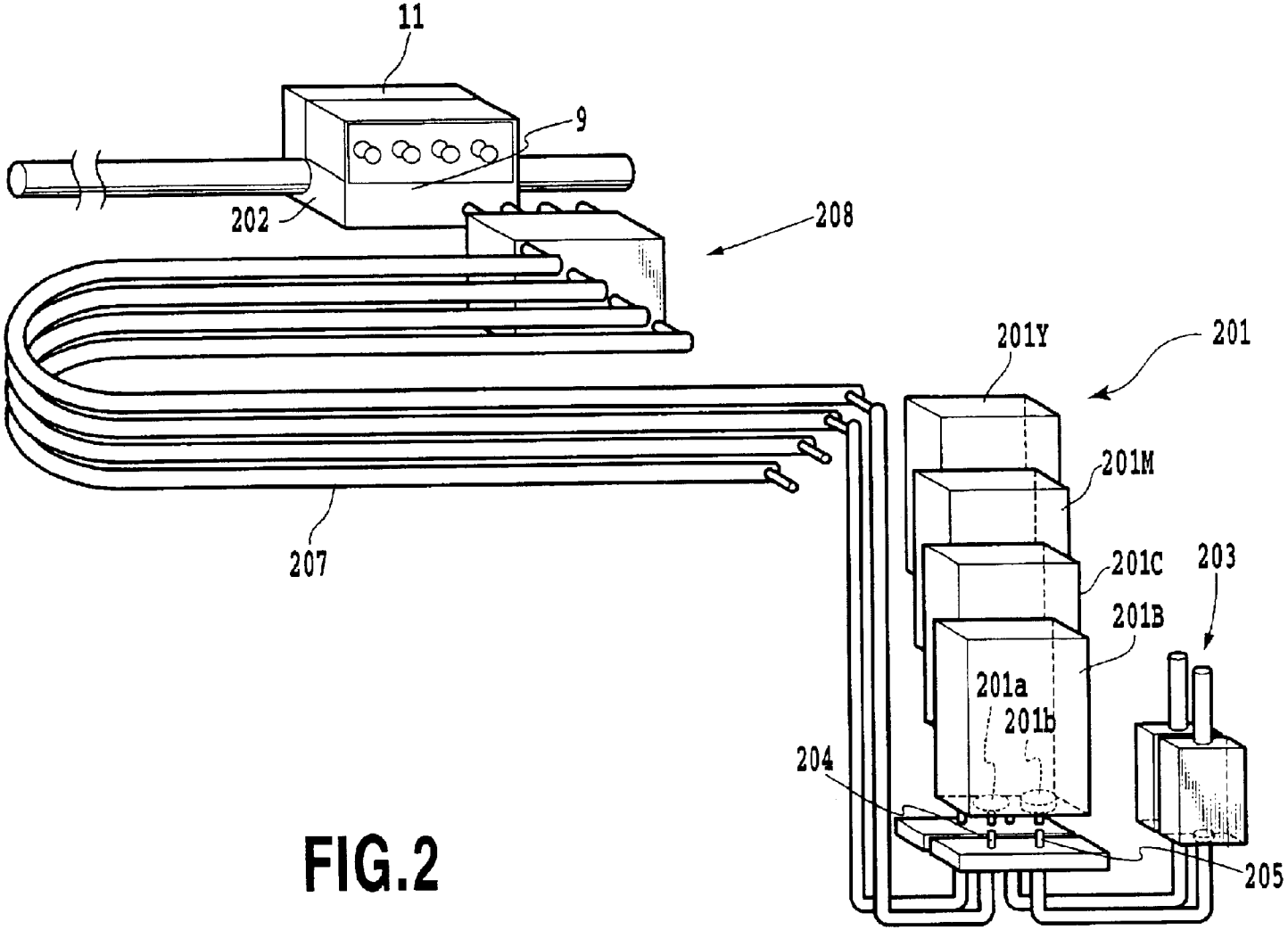
FIG. 2 is a perspective view showing an outline construction of an ink supply system in the apparatus of FIG. 1A.

FIG. 2 is an explanatory diagram showing an ink supply system in the ink jet printing apparatus of this embodiment. Inks are supplied from main ink tanks 201 through tubes 207 and joints 208 to small-size and small-capacity ink tanks (subtanks) 202 mounted on the carriage 11, from which they are further supplied into the print heads 9. The main ink tanks 201Y, 201M, 201C, 201K contain yellow, magenta, cyan and black inks, respectively. Denoted 203 is a buffer chamber.

The print heads 9 may be supplied with inks directly from the main ink tanks 201 located at a low position in the apparatus body. However, in reducing a load of the carriage motor 12 for higher printing speed, smaller size and lighter weight of the ink jet printing apparatus, it is effective to reduce the size of the subtanks 202 mounted on the carriage 11 as in this embodiment. That is, the subtanks 202 are mounted on the carriage 11 to supply inks to the associated print heads 9 and are also replenished with inks from the main ink tanks 201 of relatively large capacity located at predetermined positions in the apparatus body. When the carriage 11 moves to a predetermined position such as a home position, the joints 208 connect to the subtanks 202 to establish ink supply paths between the subtanks 202 and the main ink tanks 201. Thus, by connecting the subtanks 202 to the joints 208 at an optimum timing determined by the capacity of the subtanks 202 and the ink consumption by the print heads 9, inks can be supplied from the main ink tanks 201 to the subtanks 202.

The main ink tanks 201 (see FIG. 2) are formed of PP (polypropylene) and PE (polyethylene) as by injection molding, blow molding and fusion welding. The main ink tanks 201 used may be ones whose enclosures function as ink chambers, ones which hold therein a bag filled with ink, or ones which contain a porous material holding ink and generate a negative pressure therein. When a negative pressure generating mechanism is provided to each of the ink tanks 201, a spring-loaded mechanism may be installed inside or outside the ink-containing bag in the ink tanks 201 to urge the bag to expand and thereby generate a negative pressure. This embodiment has an ink supply system using the tubes 207 as shown in FIG. 2 and the negative pressure is generated by a pressure head between the print heads 9 and the ink tanks 201.

Figure 7:
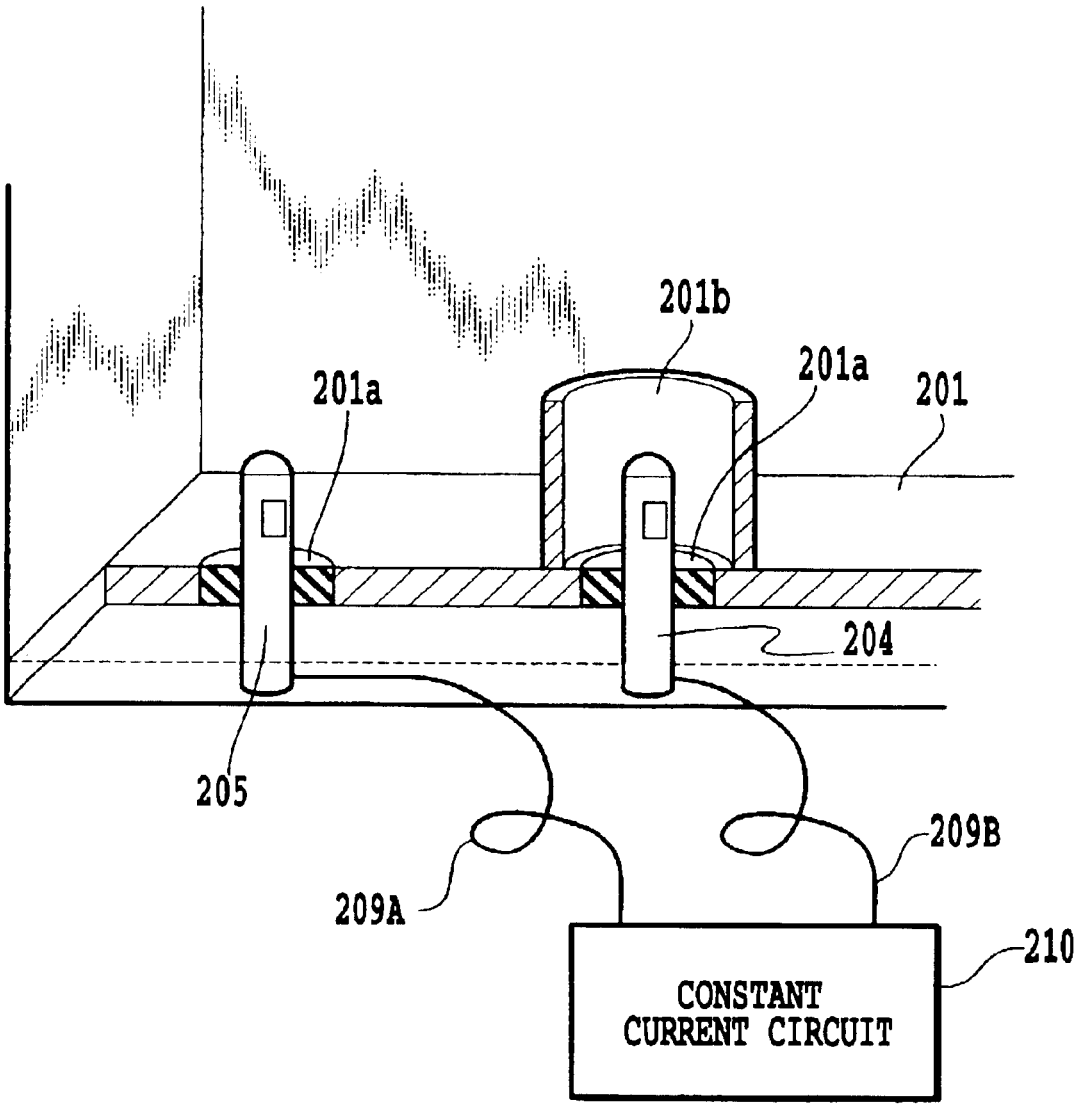
FIG. 7 is a partly cutaway perspective view showing a construction of an ink residual volume detection means in the embodiment of this invention.

The ink tanks 201 in this embodiment are formed by fusion-welding a bottom part to the PP enclosure. Each of the ink tanks 201Y, 201M, 201C, 201K has two rubber joints 201*a* at two different locations on the bottom, as shown in FIG. 7, through which pins 204, 205 on the apparatus body side are removably inserted. One of the pins 205 supplies ink from the tank 201 to the associated print head 9 and the other pin 204 is an outer air communication pin to allow an atmospheric pressure to be introduced into the ink tank as the negative pressure in the ink tank 201 increases with the decreasing amount of ink in the tank. On the inside of the joint through which the atmosphere communication pin 204 is inserted, an annular wall 201*b* of a predetermined height enclosing the joint is formed.

Figure 3:
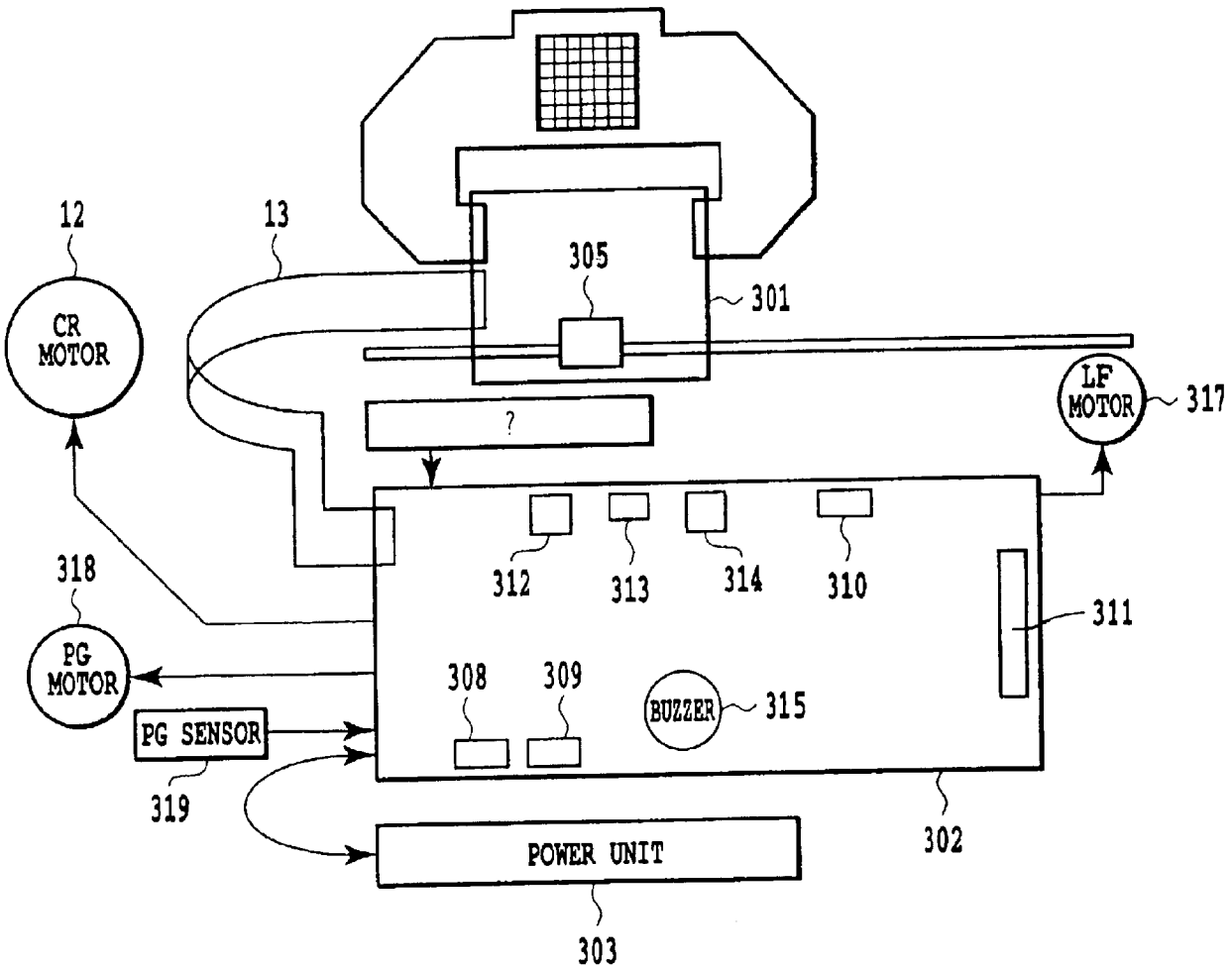
FIG. 3 is a block diagram schematically showing an overall configuration of an electric circuitry in the embodiment of this invention.

Next, an electric circuit configuration in this embodiment of the invention will be explained by referring to the block diagram of FIG. 3.

The electric circuit in this embodiment mainly has a carriage board 301, a main PCB (printed circuit board) 302, and a power unit 303. The power unit 303 is connected to the main PCB 302 to supply a variety of drive voltages. The carriage board 301 is a printed circuit board unit mounted on the carriage 11 (FIG. 1) and is connected to the main PCB 302 through a flexible cable 13.

The main PCB 302 is a printed circuit board unit for controlling the operation of various parts of the ink jet printing apparatus of this embodiment. The main PCB 302 has I/O ports for paper end sensor (PE sensor) 308, ASF sensor 309, cover sensor 310, parallel interface (parallel I/F) 311, resume key 312, LED 313, power key 314, buzzer 315, etc. and is connected to CR motor 12, LF motor 317 and PG motor 318 for their drive control. It also has connection interfaces with PG sensor 319, flexible cable 13 and power unit 303.

Figure 4:
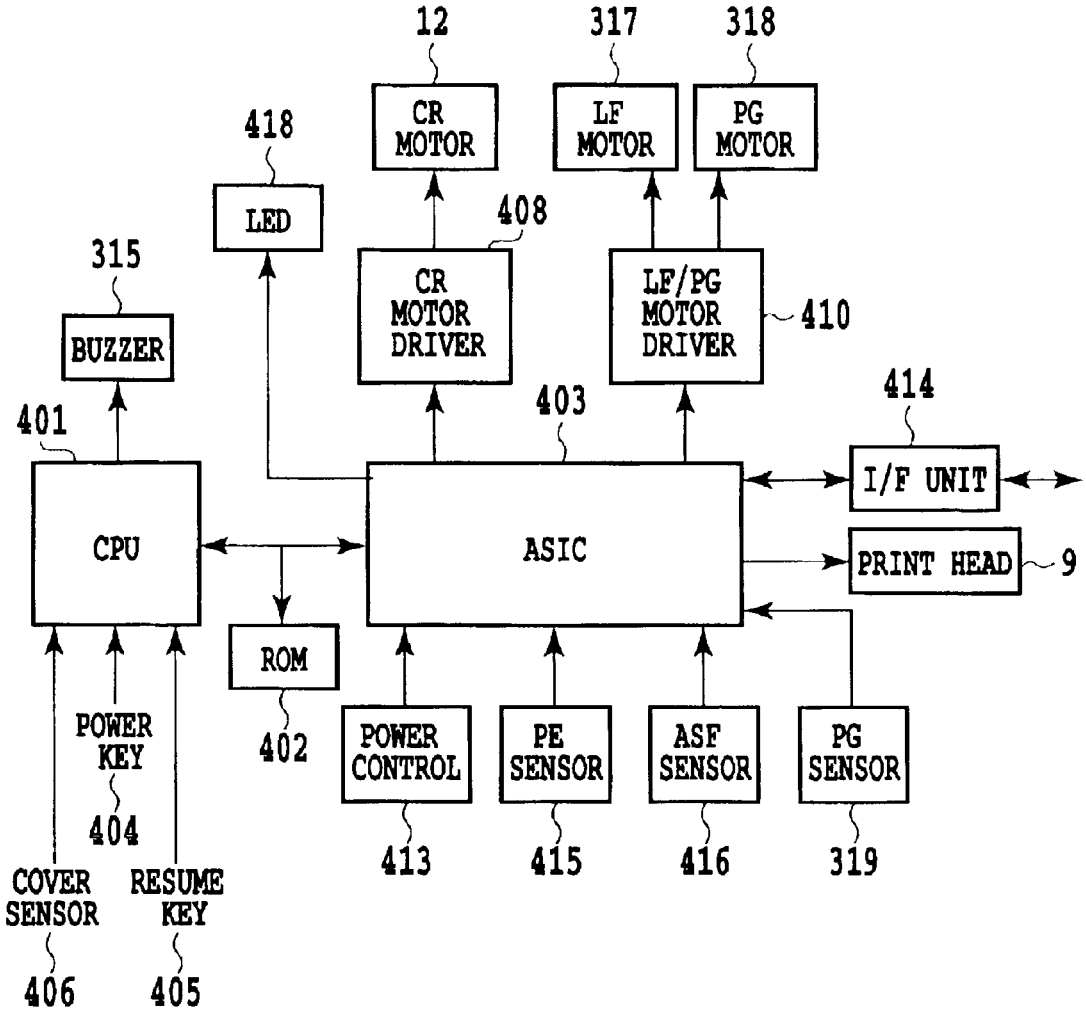
FIG. 4 is a block diagram showing a configuration of a main printed circuit board (PCB) in the embodiment of this invention.

FIG. 4 is a block diagram of the main PCB of the printing apparatus of this embodiment. In the figure, designated 401 is a CPU which is connected through a control bus to a ROM 402 and an ASIC (application specific integrated circuit) 403, and, according to programs stored in the ROM 402, performs control on the ASIC, receives an input signal 404 from the power key, an input signal 405 from the resume key, and an input signal 406 from a cover detecting sensor and detects a residual ink volume in the ink tank. The CPU 401 also performs various logic operations and makes decisions on conditions, thus functioning as a control means for the print heads and the ink jet printing apparatus.

Denoted 408 is a CR motor driver which generates a CR motor drive signal, in order to drive the CR motor, according to a CR motor control signal from the ASIC 403. Denoted 410 is an LF/PG motor driver which generates PM drive signals, in order to drive the LF motor and the PG motor, according to an LF pulse motor control signal (PM control signal) and a PG motor control signal which are sent from the ASIC 403, respectively.

Denoted 413 is a power control circuit 413 which, according to a power control signal from the ASIC 403, controls power supply to various sensors with LEDs. A parallel I/F 414 transfers a parallel I/F signal from the ASIC 403 to a parallel I/F cable connected to external circuits and also transfers a signal from the parallel I/F cable to the ASIC 403.

The ASIC 403 is a one-chip semiconductor integrated circuit which is controlled by the CPU 401 through the control bus to output the CR motor control signal, PM control signal, PG motor control signal, power control signal, head power ON signal and motor power ON signal and transmits and receives signals to and from the parallel I/F 414. The ASIC 403 also checks the statuses of a PE sensor signal from the PE sensor 415, an ASE sensor signal from the ASE sensor 416 and a PG sensor signal from the PG sensor 319 and transfers the data representing the statuses of these signals to the CPU 401 which, based on the received data, controls the LED drive signal to turn the LED 418 on or off. Further, the ASIC 403 has a dot count function, described later, to count the number of ink droplets ejected from the print heads 9 to determine the ink ejection volume of each print head.

Figure 5:
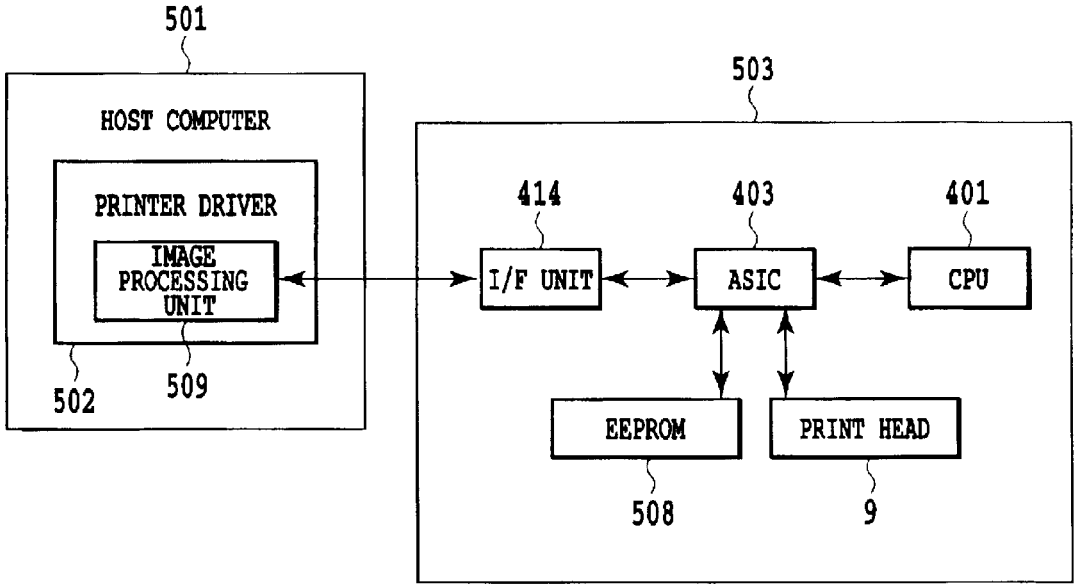
FIG. 5 is a block diagram showing a connection between the host computer and the printing apparatus in the embodiment of this invention.

FIG. 5 shows a system configuration comprising a printing apparatus and a host computer. In the figure, denoted 501 is a host computer which is connected to the printing apparatus 503 and mainly generates data to be used for printing. Designated 502 is a printer driver for processing print data. The host computer 501 sends print data given by an application software to the printing apparatus 503 from an image processing unit 509, described later, in the printer driver 502. Via two-way communication, the host computer 501 receives status information such as error data and head ejection volume information and modifies the processing method according to the head ejection volume information, which is one of the features of this invention. The transfer of this information and the processing method will be detailed later.

The ASIC 403 sends and receives data to and from the host computer 501 through the I/F unit 414. The CPU 401 exchanges data signals and control signals with the ASIC 403 to perform various controls on the operation of the printing apparatus 503. The ASIC 403 has a dot counter (ejection number detecting means) for counting the number of ink droplets. This dot counter counts both the number of ink droplets ejected to form an image and the number of ink droplets ejected during an "idle or preliminary ejection" operation to maintain the ejection characteristic. The CPU 401 receives control signals for the print heads 9 through the ASIC 403 to perform various controls on the heads. Further, the printing apparatus 503 has an EEPROM 508 whose content is sent to the CPU 401 through the ASIC 403 at a predetermined timing. The EEPROM 508 has information on ejection volume of each print head 9.

Next, the method of determining the amount of ink in each droplet ejected from the print heads 9 will be explained.

Figure 6:
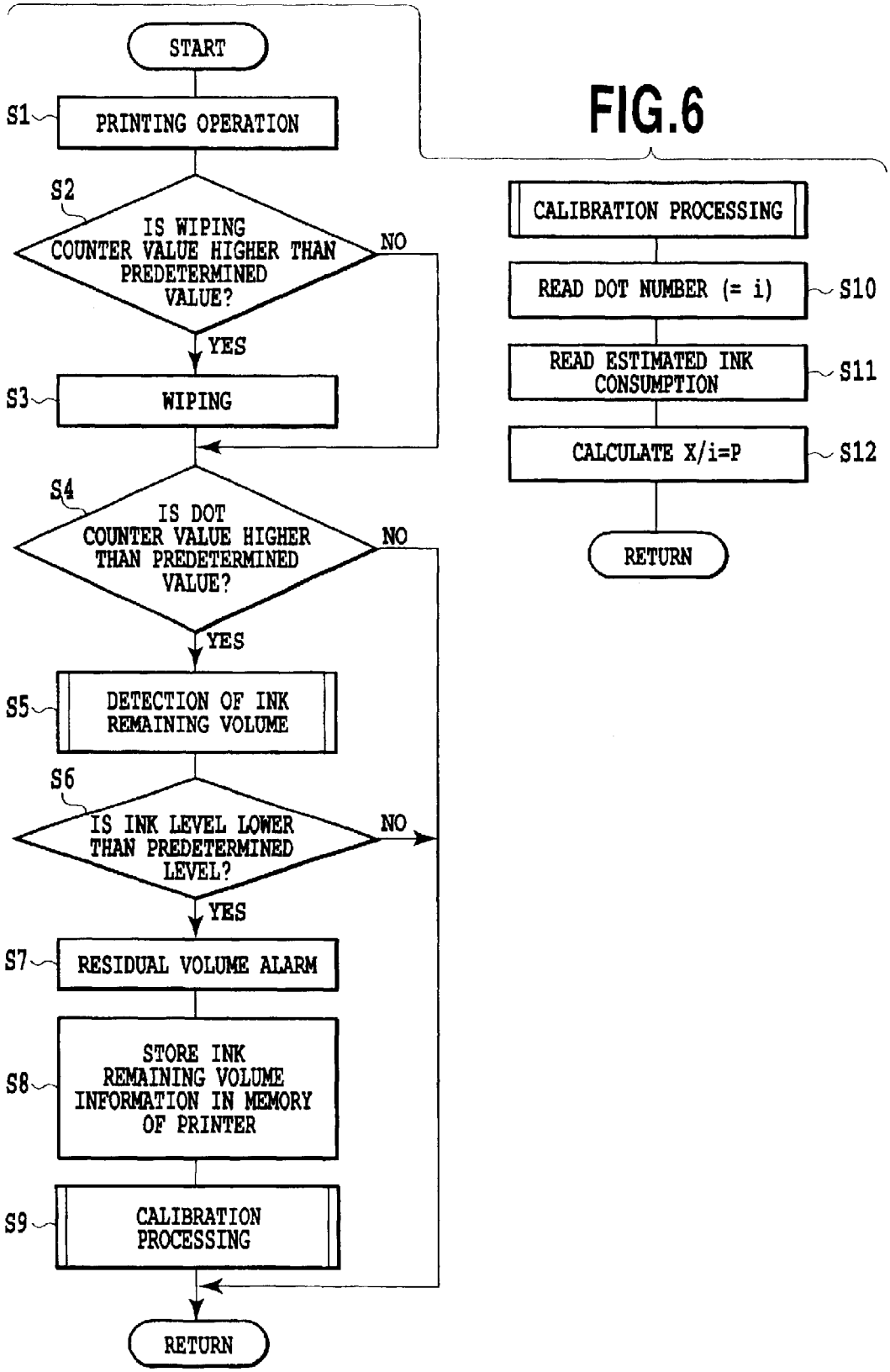
FIG. 6 is a flow chart showing a sequence of control operation in the embodiment of this invention.

FIG. 6 is a flow chart showing a sequence of the printing operation. First, after a printing operation (step S1), a wiping counter is checked to see if the wiping needs to be done (step S2). Generally, whether or not to perform the wiping on the nozzle-formed surfaces of the print heads 9 is determined by the number of ink droplets from the print heads 9 (corresponding to the number of dots formed), a printing time and a print duty. Here, the wiping is executed when the count value of the wiping counter that counts the number of ink droplets ejected reaches a predetermined value (step S2, S3). The number of ink droplets can be determined based on the image data. The wiping counter is reset each time the wiping is completed. After the wiping is finished, it is checked whether the count value of the dot counter exceeds a predetermined value to detect the remaining amount of ink (step S4). The dot counter counts the number of ink droplets from the print heads 9 and is reset when the main ink tank 201 is replaced.

The dot counter together with its count value decision means forms an ink residual volume detection means. The detection means can be built by software and hence is also called a "software-built detection means."

In this software-built detection means, when the count value of the dot counter has not yet reached a predetermined value, the next printing operation is performed without executing the ink residual volume check using a hardware-built detection means described later. If print data for the next printing operation is not transferred, a print end operation that performs wiping and capping is executed after the elapse of a predetermined time. When the count value of the dot counter reaches the predetermined value, the ink residual volume detection is executed (step S5).

In the ink residual volume detection of step S5, an ink detection means having mechanical electrodes (also referred to as a "hardware-built detection means") is used to detect the ink residual volume. During the detection, unnecessary operations other than the ink residual detection operation are stopped in order to avoid electrical noise. If there is no influences of noise, however, the ink residual detection may be performed simultaneously with the printing operation. In that case, the need for specially setting in the printing operation period a waiting time for the ink residual volume detection is obviated.

The hardware-built detection means may be constructed by using the supply pin 205 and the atmosphere communication pin 204 as its electrodes. That is, the supply pin 205 and the atmosphere communication pin 204 are formed of a conductive metal and connected with one end of conductive wires 209A, 209B. The conductive wires 209A, 209B at the other end are connected to a constant current circuit 210. The constant current circuit 210 applies a DC current of 100 $\mu$A between the pins 205 and 204 with 5 V at maximum. Thus, when there is no ink in the tank 201 or when the tank 201 is not mounted, the maximum voltage of 5 V is applied. When the pins 205, 204 are electrically connected with each other by the ink in the tank 201, the applied voltage changes according to the resistance of the ink. The hardware-built detection means detects the presence of ink in the tank 201 according to a change in the applied voltage.

Figure 8:
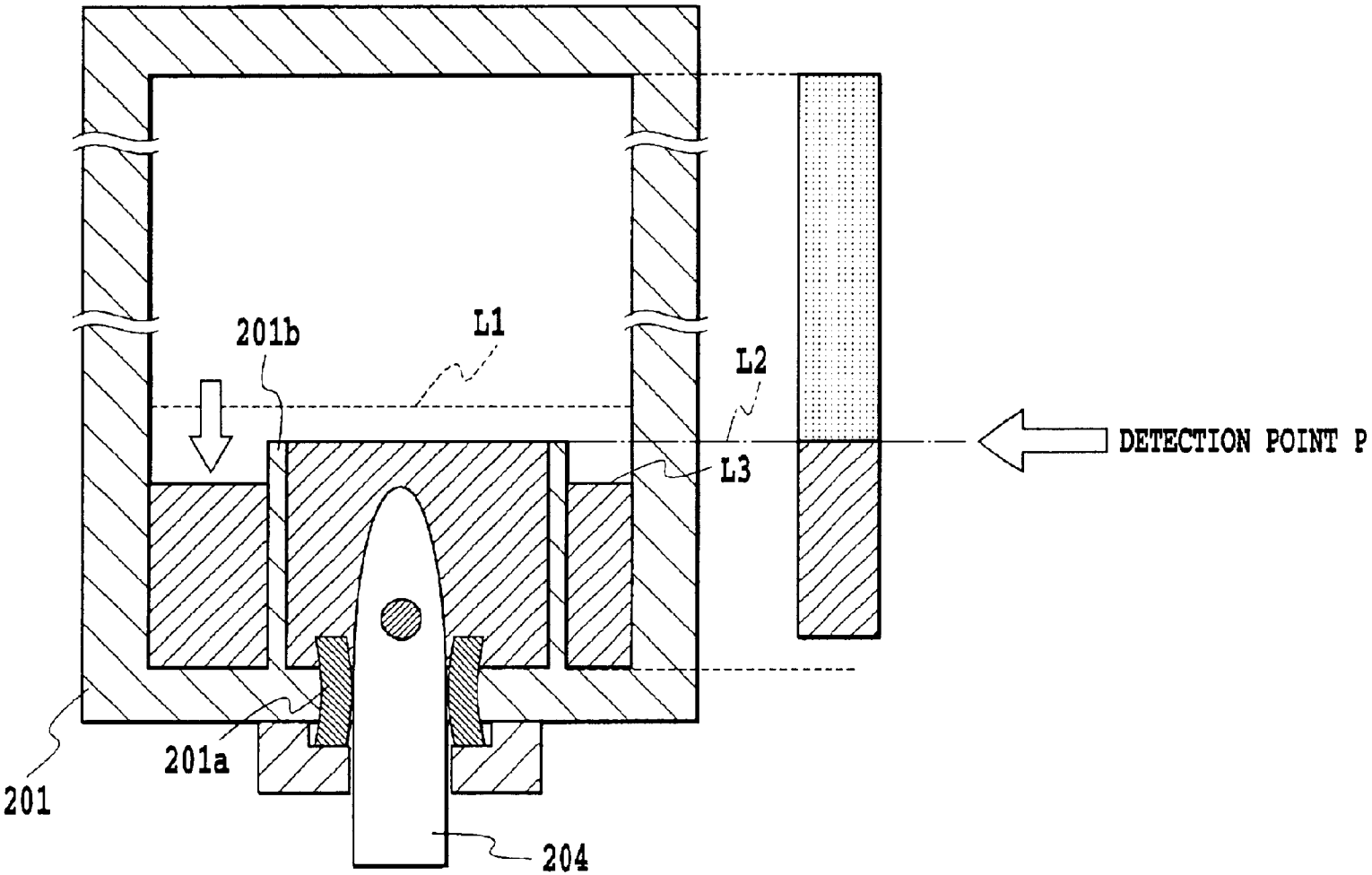
FIG. 8 is an explanatory vertical, side cross-sectional view showing an ink residual volume detection principle used by the means of FIG. 7.

FIG. 8 shows the ink detection principle. In the figure, the ink level in the tank 201 progressively lowers to level L1, L2 and L3 as the ink is consumed. When the ink level is higher than the upper end of the annular wall 201*b* enclosing the atmosphere communication pin 204, as shown at L1, the atmosphere communication pin 204 and the supply pin 205 that work as electrodes are electrically connected through the ink in the tank 201 that exists on both sides of and over the annular wall 201*b*. When the ink level is lower than the upper end of the annular wall 201*b*, as shown at L2, the inks on the inner and outer side of the annular wall 201*b* are separated from each other by the annular wall 201*b*, electrically disconnecting the pins 204, 205. Hence, when the ink level reaches the upper end of the annular wall 201*b*, as shown at L2, the applied voltage between the pins 204 and 205 changes from that for level L1 and this level constitutes a detection point P. Based on the change in the applied voltage, the hardware-built detection means detects when the ink level reaches L2.

Returning to FIG. 6, at step S6 the ink residual volume is checked by the hardware-built detection means to see if the ink residual volume is equal to or lower than the predetermined level, i.e., whether the ink level is equal to or lower than the level L2. If the ink residual volume is equal to or lower than the predetermined level, an alarm is issued (step S7) and the ink residual volume information is stored in memory units provided in the tank and the equipment body (step S8).

The next step S9 executes calibration processing. First, a count value of the dot counter in the software-built detection means (referred to as a "dot number i") is read (step S10) and then an estimated ink consumption X at a time of detection operation by the hardware-built detection means is read (step S11). The estimated ink consumption X is prestored, for example, in memory means provided in each ink tank 201 and corresponds to an amount of ink estimated to be consumed during a period from when the ink level in the tank 201 is at a full level until it lowers to a level of the detection point P of FIG. 8. Next, the amount of ink per droplet ejected from each print head (ink volume of one ejection or one dot), p (=X/i), is calculated (step S12) and stored in the EEPROM 508 (see FIG. 5) in the tank 201, print head 9 or apparatus body or in a memory means in the host device.

Next, the control to change image processing parameters based on the ejection volume of each print head determined will be explained. The image processing parameter modification is executed by the image processing unit 509 in the printer driver 502 installed in the host computer 501 of FIG. 5 or by the CPU 401 of the printing apparatus 503 of FIG. 5. More specifically, in a configuration where the image processing parameter is changed by the printer driver 502, the steps performed by the image processing unit 509 involve storing in advance an output gamma correction table (LUT) of FIG. 12 in a memory means in the host computer 501, receiving the "ink volume per droplet p (=X/i)" determined by step S12 of FIG. 6 from the printing apparatus 503, selecting an output gamma correction table (LUT) to be used according to the received ink volume p, and modifying the image processing parameter based on the selected table. On the other hand, when the image processing parameters are changed by the printing apparatus 503, the required steps involve storing in advance the output gamma correction table (LUT) of FIG. 12 in a memory means in the printing apparatus 503, selecting an output gamma correction table (LUT) according to the "ink volume per droplet p (=X/i)" determined by step S12 of FIG. 6, and modifying the image processing parameter based on the selected table.

Figure 9:
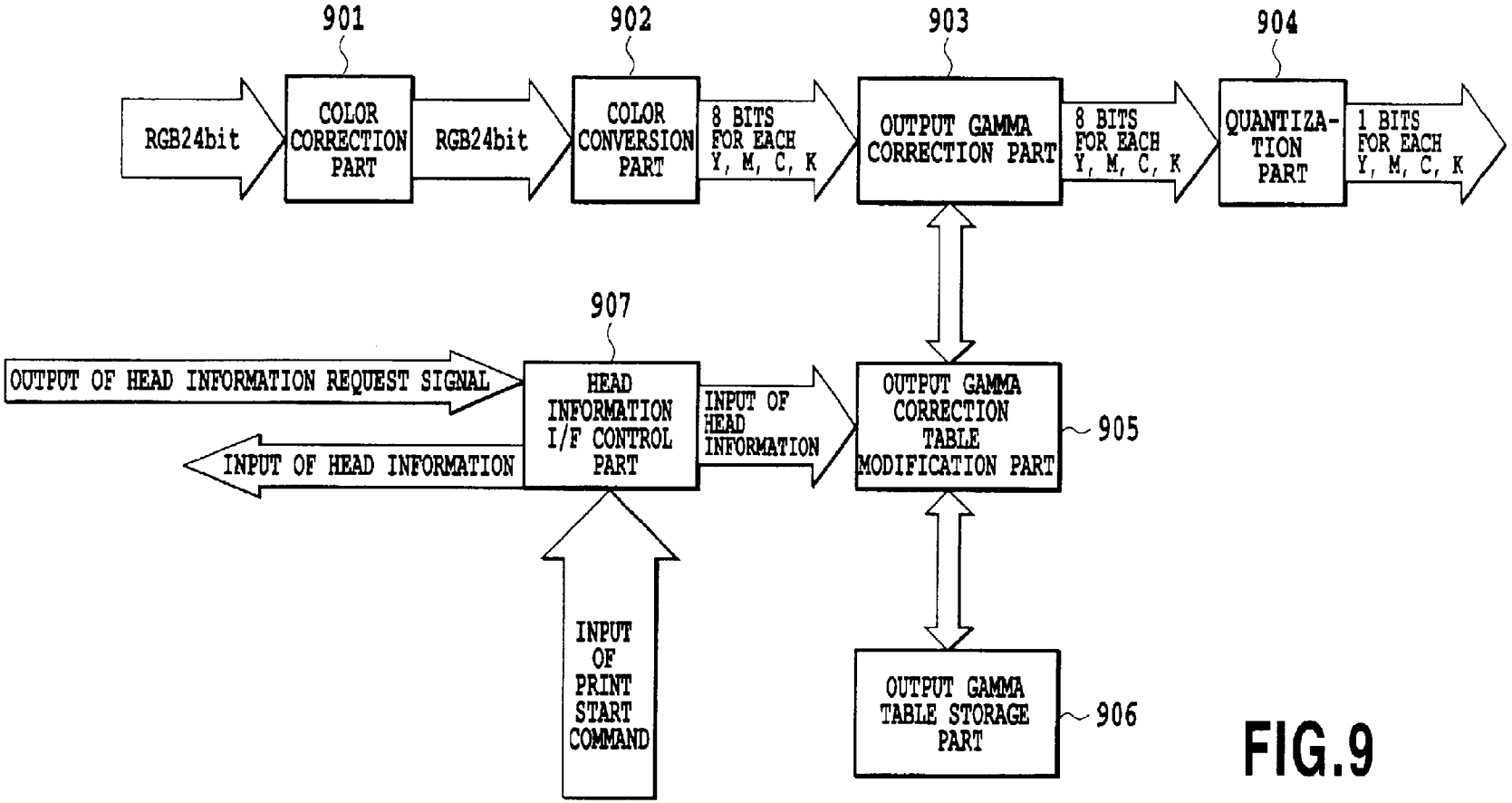
FIG. 9 is a block diagram showing a functional configuration of an image processing unit in the embodiment of this invention.

FIG. 9 is a block diagram showing a functional configuration of the image processing unit in this embodiment. First, 24-bit image data (8 bits for each of R, G, B) is input to a color correction part 901, which performs the color correction processing on the received RGB print data to produce a 24-bit RGB print signal by using a three-dimensional LUT (lookup table). The color correction part 901 converts a color space of the input print data into a standard color space to secure a uniform color reproduction among various input/output devices and also execute a user preferential color reproduction or a stored color reproduction. A color conversion part 902 converts the color-corrected RGB value into 32-bit print data (8 bits for each of Y, M, C, K) in a color space of the printer as an output device by using the same three-dimensional LUT.

Next, an output gamma correction part 903 performs an output gamma correction for each color independently by using a one-dimensional LUT. In the output gamma correction part 903, the output gamma characteristic is corrected according to the ink volume for each print head.

Figure 10:
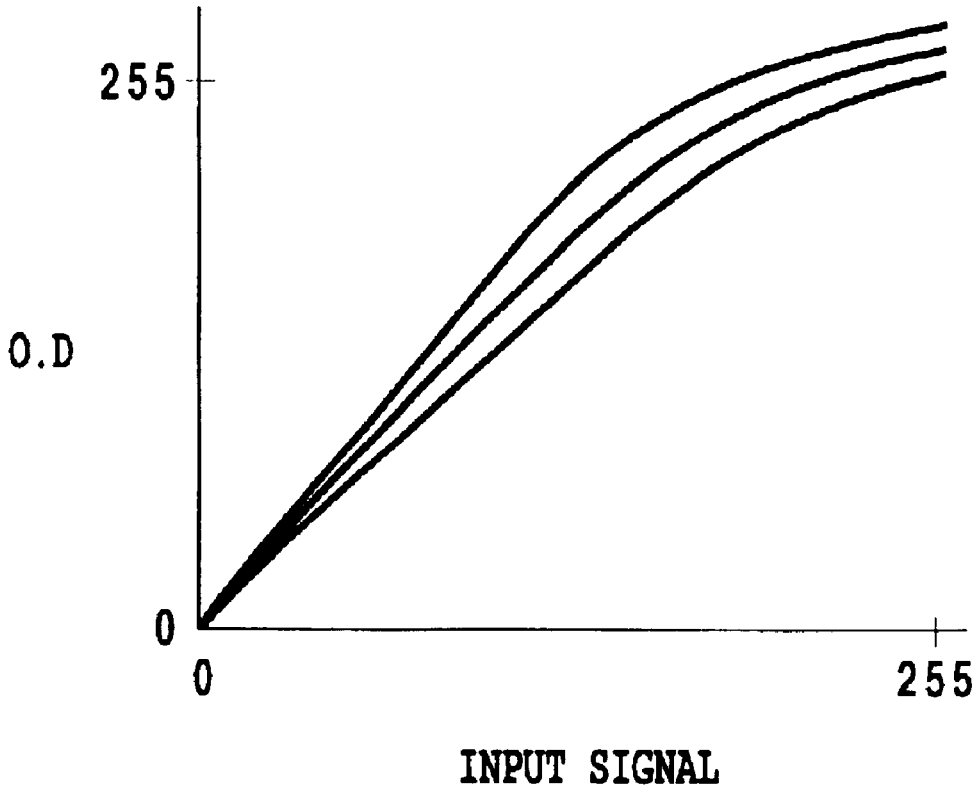
FIG. 10 is a graph showing an output gamma characteristic for each ink ejection volume in the embodiment of this invention.
Figure 11:
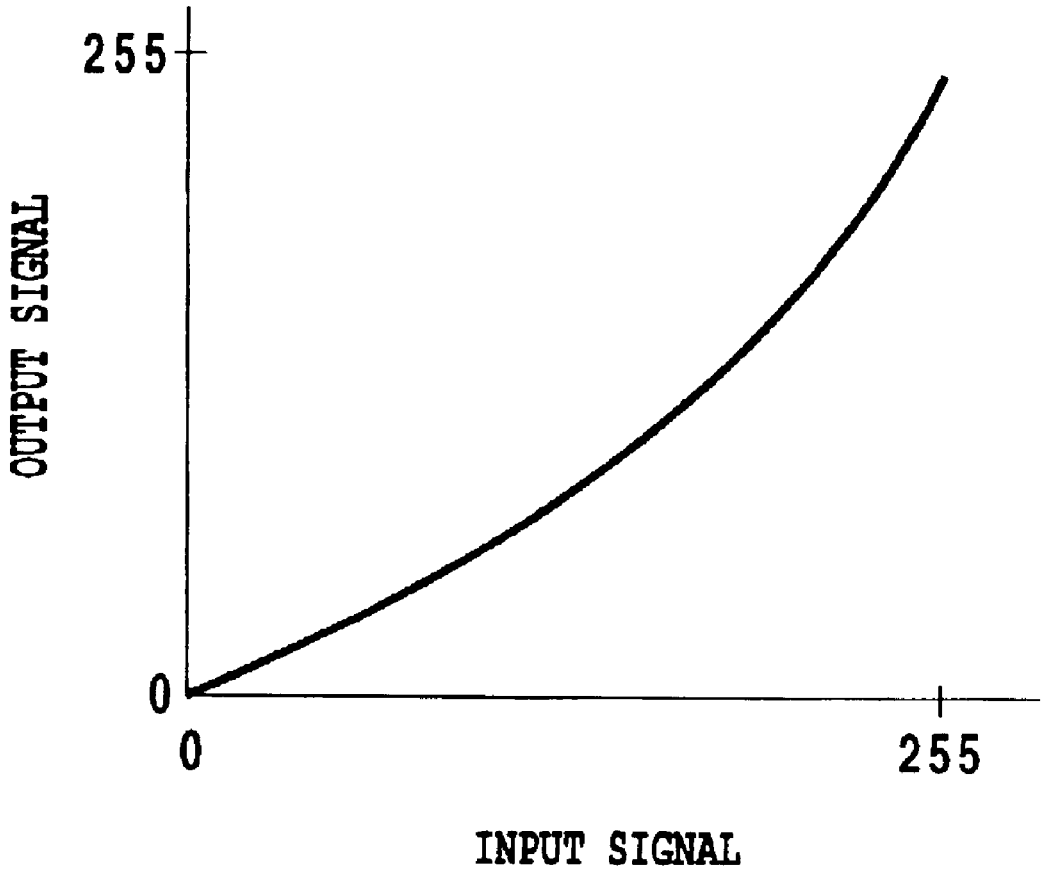
FIG. 11 is a graph showing a relation between an input signal and an output signal in the embodiment of this invention.

Here, output gamma characteristics for different ejection volumes will be explained with reference to FIG. 10. In FIG. 10, the abscissa represents an 8-bit (0–255) signal value for each color before being subjected to the output gamma correction and the ordinate represents a reflection density (0.D) of patches output with the signal value. As shown in the figure, the characteristic is such that the reflection density at each grayscale is higher for a larger ejection volume and is lower for a smaller ejection volume. Considering that the printer has the output gamma characteristic described above, the output gamma correction is performed using an output gamma correction table with such an input vs. output signal value characteristic as shown in FIG. 11 so that the reflection density will be linear with respect to the input.

In this embodiment, the output gamma correction table is prepared for each print head and stored in the output gamma table storage part 906 of FIG. 9.

Although this embodiment uses the output gamma correction table to correct the output characteristic according to variations in ejection volume among the print heads, the present invention is not limited to this method. For example, a plurality of LUTs for different ejection volumes may be prepared for the color correction part 901 and for the color conversion part 902 and the desired correction table may be selected according to the ejection volume. In other words, what is needed is to correct the relation between the ink ejection volume and the output density to ensure that the output density does not change if the ink ejection volume changes.

An output gamma correction table modification part 905 checks, through the head information I/F control part 907, whether it is necessary to change the table for another output gamma correction table and makes changes as necessary.

A quantization part 904 receives the output gamma-corrected 8-bit print data for each color and quantizes the data into a quantity representing the number of grayscale levels that can be expressed by the printer, i.e., in this example of FIG. 9, a 1-bit binary value. Normally, this quantization is performed by using dither processing and error diffusion processing capable of pseudo-half tone representation.

FIGS. 12A and 12B show an example of a gamma correction table used in this embodiment. As shown in FIGS. 12A and 12B, the output gamma correction table has LUTs for each color prepared for different levels of ejection volume (five levels in this case). That is, for each input signal value, there are five LUTs representing different output signal values that correspond to five levels of ejection volume ("ejection volume+2", "ejection volume+1", "ejection volume 0", "ejection volume−1" and "ejection volume−2").

Then a check is made to find which of the five levels the ink ejection volume (ink ejection volume per ink droplet) p, determined as described above, matches. The LUT corresponding to that level is selected and the output gamma correction is performed using the selected LUT.

Here, the ejection volume per ink droplet (p) is assumed to be 5 pl (picoliter) and the five ejection volume levels are defined as shown in Table 1. It is obvious that the number of ejection volume levels is not limited to five, nor is the range of each level limited to that shown in Table 1. These can be changed during the design stage according to the use and purpose of the printing apparatus.

TABLE 1

| Level | Range of ejection volume (p) |
|---|---|
| Ejection volume −2 | $p < 4.25$ p1 |
| Ejection volume −1 | $4.25$ p1 $\leqq p < 4.75$ p1 |
| Ejection volume 0 | $4.75$ p1 $\leqq p < 5.25$ p1 |
| Ejection volume +1 | $5.25$ p1 $\leqq p < 5.75$ p1 |
| Ejection volume +2 | $5.75$ p1 $\leqq p$ |

By preparing a plurality of LUTs corresponding to different ink ejection volumes (different ink ejection volumes per droplet), the image processing parameters (used to correct the relation between the ink ejection volume and the output density) can be modified appropriately according to the ejection volume even if the "ink ejection volume per droplet p (=X/i)" determined by step S12 of FIG. 6 changes over time. This allows the image density to be stabilized over a long period of time from the initial stage of use of the print heads until the end of their service life.

As described above, in this embodiment the hardware-built detection means detects when the ink residual volume reaches a predetermined value and, at this point in time, the volume of ink per droplet is calculated from the number of ink ejections (i) and the ink consumption (X) and used to change the image processing parameters so that the image density can be kept constant without being influenced by variations in the ink volume per droplet. Therefore, if the volume of each ink droplet changes as a result of electro-thermal transducers being burned or their thickness changing, a calibration (output gamma correction) optimum to the ink droplet volume change can be executed to produce stable, high quality images at all times.

Since the actual ejection volume of each print head is not known, the initial value to be set in the printing apparatus may be given a center value of ejection volume variation of the print head, for example. Alternatively, ejection volumes may be measured during the manufacturing process of the print heads and the measured values may be stored in the apparatus. Or a memory means such as an EEPROM may be provided in each print head and written with an initial value of the ink ejection volume, which will be read out for the output gamma correction.

Other Embodiments

Next, other embodiments of the present invention (second to fourth embodiments) will be described. The second to fourth embodiments also employ a similar construction to that shown in FIG. 1 to FIG. 12B that has been described in connection with the first embodiment, except for the differences that will be explained in the following.

Second Embodiment

In the first embodiment, it is assumed that ink is consumed only by the ejection from the print heads. In the ink jet printing apparatus, a recovery operation such as cleaning is normally performed when a predetermined condition is reached. Taking the ink consumption by this recovery operation into account can calculate the ink droplet volume more precisely.

That is, when this recovery operation is executed, the volume of ink sucked out (discharged) by a recovery means (ink suction means such as pump) is converted into the number of dots, which is then counted to determine the number of ink droplets ejected. This results in a more precise calculation of the ink droplet volume.

Further, where there is a possibility of the ink ejection volume being varied by the suction operation depending on the characteristic of the printing apparatus, the calculation of the ejection volume of the print head may be stopped when the recovery operation by suction is performed during the use of one ink tank. Only when the recovery operation is not performed, may the calculation of the print head ejection volume be performed.

Further, rather than reflecting the print head ejection volume calculated from the use of only one ink tank on the image processing parameters, an average, preferably a moving average, of ejection volume calculated from the use of a plurality of ink tanks is used to determine the image processing parameters. This allows more stable, high quality images to be produced.

Third Embodiment

Although the first embodiment has been described to employ the ink supply system in which the main ink tanks as the ink source and the subtanks are connected through tubes, this invention can also be applied to a configuration with no ink supply system in which the ink tanks and the print heads are mounted on the carriage. This configuration may be such that each print head and its associated ink tank are formed separately, allowing only the ink tanks to be replaced or such that each print head and the associated ink tank are formed integrally and both are replaced as one piece.

Fourth Embodiment

While the first embodiment has been described to modify the image processing parameters according to the ink volume of each droplet, this invention is also applicable to a variety of controls on the printing apparatus.

Figure 13A:
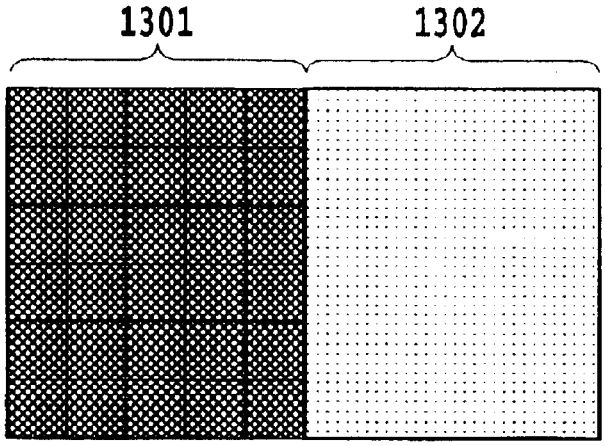
FIGS. 13A, 13B and 13C are explanatory diagrams showing a preliminary forming of dots of color inks in a black image forming area in a third embodiment of this invention.
Figure 13B:
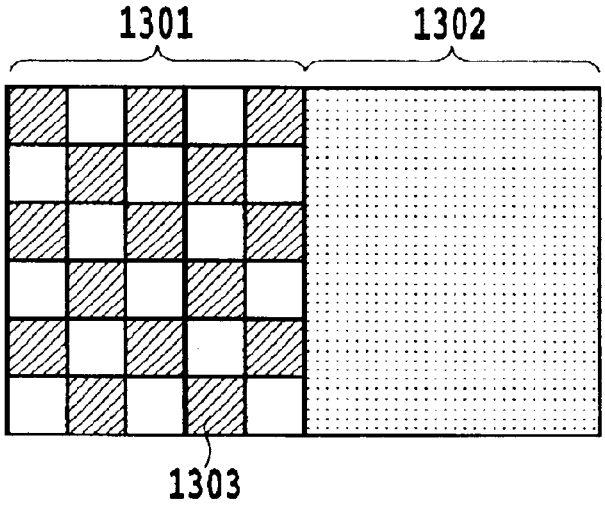
Figure 13C:
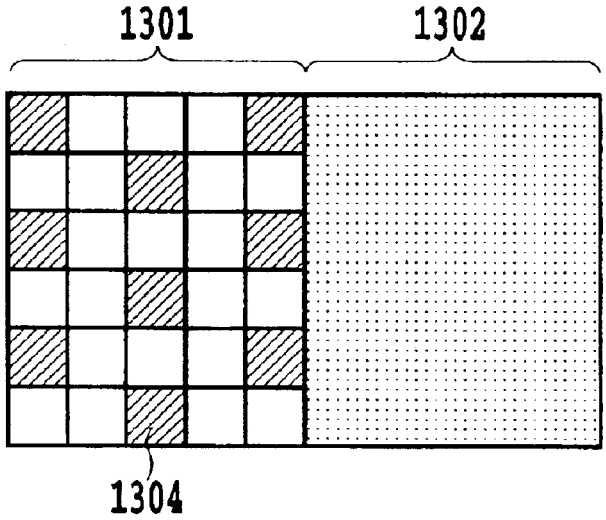

FIGS. 13A, 13B and 13C show one such example. FIG. 13A represents a case where a black image 1301 and a yellow image 1302 adjoin each other. Here it is assumed that a Bk ink to form the Bk image is an overlying type ink with a low print paper penetration characteristic (low penetration ink) while a yellow ink to form the yellow image is an ink with a high print paper penetration characteristic (high penetration ink). In this case, in a boundary portion between the Bk image and the yellow image, bleeding occurs due to the characteristic difference between the two inks. Putting the color ink under the Bk ink can alleviate the bleeding. To minimize the bleeding, the amount of color ink normally needs to be increased even though print head variations and increased temperature of the print heads tend to increase the ink ejection volume. However, applying too large an amount of color ink makes the Bk ink, the overlying type ink, soak into the paper very easily, degrading the Bk image quality (image density). The above conflicting relationships need to be properly balanced.

In this embodiment, however, if the ink ejection volume per droplet is detected with high accuracy and the amount of color ink to be applied is adjusted according to the detected ejection volume, a high quality image can be produced. For example, when the ejection volume of Bk ink is large, the color ink is applied as an underlying ink at hatched portions 1303 in FIG. 13B. When the ejection volume of Bk ink is small, the color ink is applied as an underlying ink at hatched portions 1034 in FIG. 13C. That is, the amount of underlying color ink is set relatively large when the Bk ink ejection volume is large and, when the Bk ink ejection volume is small, is set relatively small. This method can minimize the amount of color ink applied and at the same time prevent a degradation of the Bk image quality (image density).

Further, when an overlying type Bk ink is used, a high penetration color ink may also be applied under the Bk ink to quicken the drying of a printed image. As with the problem of bleeding, although an increased volume of color ink enhances the drying performance, it also degrades the Bk image quality (image density). This problem can be solved by adjusting the color ink volume to be applied according to the black ink ejection volume to secure both the drying performance and the Bk image quality.

Fifth Embodiment

In the first embodiment, the amount of ink consumed in each ink tank and the number of ink ejections from the associated print head are detected. The detected values of the ink consumption and the ink ejection number are not limited to those values that directly represent the amount of ink consumed and the number of ejections (for example, Xp1, Y times) but may be such values as indirectly represent the amount of ink consumed and the number of ejections. That is, it is only necessary to obtain information about the ink consumption rather than a value of the ink consumption itself. Also, it is not necessary to detect a value of the ink ejection number itself but information about the ink ejection number need only be obtained.

Similarly, while these embodiments calculate the ink volume of each droplet based on the ink consumption and the number of ink ejections, the calculated value of the ink droplet volume may be a value directly representing the ink droplet volume (for example, Xp1) or a value indirectly representing the ink droplet volume. That is, rather than determining the ink droplet volume itself, information related to the ink droplet volume needs only to be determined.

Therefore, the present invention also includes processing which involves (1) obtaining information about the ink consumption in each ink tank, (2) obtaining information about the number of ink ejections from the print head, (3) determining ink droplet volume information based on the ink consumption information and the ink ejection number information, and (4) changing the print operation processing (image processing such as output gamma correction) according to the ink droplet volume information.

As described above, since this invention calculates the ink ejection volume that changes over time and, based on the calculated result, corrects data associated with the image forming processing, it is possible to produce high quality images at all times from the initial stage of use of the printing apparatus till the end of its service life.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An ink jet printing apparatus for printing an image on a print medium by using a print head, wherein the print head can eject ink supplied from an ink tank, the ink jet printing apparatus comprising:

ink consumption detection means for detecting an amount of ink consumed in the ink tank;

ejection number detection means for detecting the number of ink ejections from the print head;

ink droplet volume calculation means for calculating an ink droplet volume based on the number of ink ejections from the print head detected by the ejection number detection means and the ink consumption detected by the ink consumption detection means; and control means for changing processing associated with a printing operation according to the ink droplet volume calculated by the ink droplet volume calculation means, wherein the control means changes, based on the ink droplet volume calculated by the ink droplet volume calculation means, image processing parameters used to perform image processing on print data representing an image to be printed, and wherein the image processing parameters are parameters to correct a relation between the ink droplet volume and an output density.

2. An ink jet printing apparatus according to claim 1, wherein the ink consumption detection means detects the ink consumption by detecting a level of ink contained in the ink tank.

3. An ink jet printing apparatus according to claim 2, wherein, when the ink level in the ink tank is detected to have reached a predetermined position, the ink consumption detection means determines a predetermined consumption prestored in memory means provided in the ink tank as the ink consumption.

4. An ink jet printing apparatus according to claim 1, wherein the ejection number detection means determines as the number of ink ejections a value which is calculated from the actual number of ink droplet ejections from the print head and an ejection number converted from an ink discharge volume during a recovery operation of the print head.

5. An image processing method for processing print data used to print an image on a print medium by using a print head, wherein the print head can eject ink supplied from an ink tank, the image processing method comprising:

an ink consumption detection step for detecting an amount of ink consumed in the ink tank;

an ejection number detection step for detecting the number of ink ejections from the print head;

an ink droplet volume calculation step for calculating an ink droplet volume based on the number of ink ejections from the print head detected by the ejection number detection step and the ink consumption detected by the ink consumption detection step; and a change step for changing image processing performed on the print data according to the ink droplet volume calculated by the ink droplet volume calculation step, wherein the change step changes, based on the ink droplet volume calculated by the ink droplet volume calculation step, image processing parameters used to perform image processing on print data representing an image to be printed, and wherein the image processing parameters are parameters to correct a relation between the ink droplet volume and an output density.

6. An ink jet printing method for printing an image on a print medium by using a print head, wherein the print head can eject ink supplied from an ink tank, the ink jet printing method comprising:

an ink consumption detection step for detecting an amount of ink consumed in the ink tank;

an ejection number detection step for detecting the number of ink ejections from the print head;

an ink droplet volume calculation step for calculating an ink droplet volume based on the number of ink ejections from the print head detected by the ejection number detection step and the ink consumption detected by the ink consumption detection step; and a change step for changing processing associated with a printing operation according to the ink droplet volume calculated by the ink droplet volume calculation step, wherein the change step changes, based on the ink droplet volume calculated by the ink droplet volume calculation step, image processing parameters used to perform image processing on print data representing an image to be printed, and wherein the image processing parameters are parameters to correct a relation between the ink droplet volume and an output density.

7. An ink jet printing method according to claim 6, wherein the ink consumption detection step detects the ink consumption by detecting a level of ink contained in the ink tank.

8. An ink jet printing method according to claim 6, wherein, when the ink level in the ink tank is detected to have reached a predetermined position, the ink consumption detection step determines a predetermined consumption prestored in memory means provided in the ink tank as the ink consumption.

9. An ink jet printing method according to claim 6, wherein the ejection number detection step determines as the number of ink ejections a value which is calculated from the actual number of ink droplet ejections from the print head and an ejection number converted from an ink discharge volume during a recovery operation of the print head.

10. An ink jet printing apparatus for printing an image on a print medium by using a print head, wherein the print head can eject ink supplied from an ink tank, the ink jet printing apparatus comprising:

ink consumption information obtaining means for obtaining information corresponding to an amount of ink consumed in the ink tank;

ejection number information obtaining means for obtaining information corresponding to the number of ink ejections from the print head;

ink droplet volume information obtaining means for obtaining information corresponding to an ink droplet volume based on the ink ejection number information obtained by the ejection number information obtaining means and the ink consumption information obtained by the ink consumption information obtaining means; and control means for changing processing associated with a printing operation according to the ink droplet volume information obtained by the ink droplet volume information obtaining means, wherein the control means changes, based on the ink droplet volume information obtained by the ink droplet volume information obtaining means, image processing parameters used to perform image processing on print data representing an image to be printed, and wherein the image processing parameters are parameters to correct a relation between the ink droplet volume and an output density.

11. An image processing method for processing print data used to print an image on a print medium by using a print head, wherein the print head can eject ink supplied from an ink tank, the image processing method comprising:

an ink consumption information obtaining step for obtaining information corresponding to an amount of ink consumed in the ink tank;

an ejection number information obtaining step for obtaining information corresponding to the number of ink ejections from the print head;

an ink droplet volume information obtaining step for obtaining information corresponding to an ink droplet volume based on the ink ejection number information obtained by the ejection number information obtaining step and the ink consumption information obtained by the ink consumption information obtaining step; and a change step for changing image processing performed on the print data according to the ink droplet volume information obtained by the ink droplet volume information obtaining step, wherein the change step changes, based on the ink droplet volume information obtained by the ink droplet volume information obtaining step, image processing parameters used to perform image processing on print data representing an image to be printed, and wherein the image processing parameters are parameters to correct a relation between the ink droplet volume and an output density.

12. An ink jet printing apparatus for printing an image on a print medium by using a print head, wherein the print head can eject ink supplied from an ink tank, the ink jet printing apparatus comprising:

an ink consumption detector including sensors for detecting an amount of ink consumed in the ink tank;

an ejection number detection circuit that detects the number of ink ejections from the print head;

an ink droplet volume calculation circuit that calculates an ink droplet volume based on the number of ink ejections from the print head detected by the ejection number detection circuit and the ink consumption detected by the ink consumption detector; and a control circuit that changes processing associated with a printing operation according to the ink droplet volume calculated by the ink droplet volume calculation circuit, wherein the control circuit changes, based on the ink droplet volume calculated by the ink droplet volume calculation circuit, image processing parameters used to perform image processing on print data representing an image to be printed, and wherein the image processing parameters are parameters to correct a relation between the ink droplet volume and an output density.

* * * * *